US005567246A

United States Patent [19]

Bowden

[11] Patent Number: 5,567,246

[45] Date of Patent: Oct. 22, 1996

[54] INDUSTRIAL PARTS CLEANING METHOD AND SYSTEM

[75] Inventor: Donald R. Bowden, Huntsville, Ala.

[73] Assignee: Bowden Industries, Inc., Huntsville, Ala.

[21] Appl. No.: 401,933

[22] Filed: Mar. 9, 1995

Related U.S. Application Data

[62] Division of Ser. No. 212,776, Mar. 15, 1994, Pat. No. 5,421,883.

[51] Int. Cl.[6] ..... B08B 5/02; B08B 7/04

[52] U.S. Cl. ..... 134/25.4; 134/26; 134/33

[58] Field of Search ..... 134/10, 17, 25.4, 134/26, 33

[56] References Cited

U.S. PATENT DOCUMENTS

| | | | |
|---|---|---|---|
| 3,022,790 | 2/1962 | Carrie | 118/73 X |
| 3,414,249 | 12/1968 | Mescher et al. | 134/83 |
| 3,476,126 | 11/1969 | Pinkham | 134/60 |
| 3,854,445 | 12/1974 | Stolle et al. | 118/73 X |
| 3,893,843 | 7/1975 | Fry et al. | 134/10 |
| 3,910,297 | 10/1975 | Pinkham | 134/76 |
| 3,930,879 | 1/1976 | Erickson et al. | 134/25.4 X |
| 3,952,756 | 4/1976 | Sheppard | 134/133 |
| 4,170,240 | 10/1979 | Gentry | 134/57 R |
| 4,196,018 | 4/1980 | Inoko et al. | 134/33 X |
| 4,421,130 | 12/1983 | Kataishi et al. | 134/83 X |
| 4,469,526 | 9/1984 | Budinsky et al. | 134/25.4 |
| 4,483,718 | 11/1984 | Bross et al. | 134/25.1 |
| 4,561,144 | 12/1985 | Marais | 134/133 X |
| 4,651,762 | 3/1987 | Bowden | 134/111 |
| 4,772,357 | 9/1988 | Carlson et al. | 134/61 X |
| 5,015,302 | 5/1991 | Henig | 134/25.4 |

FOREIGN PATENT DOCUMENTS

| | | | |
|---|---|---|---|
| 2550794 | 5/1977 | Germany | 134/76 |
| 1009540 | 4/1983 | U.S.S.R. | 134/61 |
| 616151 | 1/1949 | United Kingdom | 134/83 |

*Primary Examiner*—Jill Warden
*Assistant Examiner*—Saeed Chaudhry
*Attorney, Agent, or Firm*—Dowell & Dowell

[57] ABSTRACT

A method for batch washing, rinsing and rust inhibiting industrial parts which utilizes an immersion wash tank into which is lowered and rotated open mesh baskets. Washing liquid in the tank is agitated by a turbo charger and the parts are flushed as the baskets are rotated. After washing, the baskets are raised and, while being rotated, are spray rinsed, sprayed with rust inhibitor and dried. Sprayed liquids are collected by a movable tray and returned to separate holding tanks. Separate filter systems are provided for the wash, rinse and rust inhibiting liquids. Monitors are provided to maintain levels in the wash and rinse tanks and to maintain proper concentrations therein.

16 Claims, 5 Drawing Sheets

16
17
18
19
20
91
90
11
97
73
72
95
96
50
125
24
25
23
52
37
31
30
82"
58
56
57
38
50
48
75
55
22

INDUSTRIAL PARTS CLEANING METHOD AND SYSTEM

CROSS-REFERENCE TO RELATED APPLICATIONS

This application is a divisional of U.S. patent application Ser. No. 08/212,776, filed Mar. 15, 1994 and now U.S. Pat. No. 5,421,883.

BACKGROUND OF THE INVENTION

1. Field of the Invention

This invention is generally directed to industrial parts and tool washing or cleaning machines and more specifically to a batch type cleaning machine having the capability to wash, rinse, and rust inhibit parts being treated. The present system incorporates an immersion washer through which cleaning liquid, which may be heated, is continuously cycled. A turbo charger is provided to agitate the liquid within the wash tank. Debris removed from the parts is circulated through a chip collector and filtration system with recycled liquid being returned to the wash tank through a plurality of jets which are mounted so to convey particles toward the filtration system. Parts are retained in open mesh baskets which are mounted to a support frame disposed within a housing provided above the wash tank. The support frame may retain one or more such baskets and is mounted to a hoist which lowers the support frame and baskets into the wash tank. The basket support frame is mounted for rotation so that the baskets are rotated within the wash liquid as the parts are being cleaned.

The baskets are provided with separate lids which are raised and lowered relative thereto. After the baskets are retained on the support frame, the lids are lowered until the parts or other items contained therein are engaged.

The present invention further includes a plurality of sprayers mounted within the housing above the wash tank through which rinse and rust inhibitive liquids are directed after the parts have been elevated from the wash tank. The sprayed rinse and rust inhibitive liquids are collected by a moveable tray which is selectively oriented between the housing and the wash tank and conveyed to a rinse tank or to a rust inhibit tank thereby preserving the amount of liquids utilized in the parts washing system and preventing cross contamination of the various fluids.

The wash tank, rinse tank, and rust inhibit tank, each include a filter system for retaining liquids therein in a purified state. In the preferred embodiment, sensors are provided in the wash tank for automatically retaining the level of liquid within the wash tank by filling the wash tank with fluid from the rinse tank when liquid levels within the wash tank reach a predetermined minimum. Further, additional sensors are provided for monitoring the electrical conductivity of the liquid within the wash tank to supply additional detergent when the electrical conductivity indicates that further detergent in the wash tank is necessary. Sensors are also used within the rinse tank to monitor water level and conductivity so that make up water may be added as necessary.

Also, in the preferred embodiment, parts are dried by a blow dryer mounted within the housing above the wash tank after the parts have been rinsed and sprayed with rust inhibitor. A support table is mounted adjacent the housing for supporting baskets prior to and after washing.

2. History of the Related Art

In the industrial machine and equipment manufacturing industries, parts and castings which are subject to machining must be cleaned to remove cuttings, oils, chips and other contaminants. In a like manner, in other industries, including the maintenance industry, items such as vehicle parts, which have been or are being maintenanced, must be cleaned to remove tars, oils, chips and metallic particles as well as other debris before the parts can be used or replaced in a vehicle.

Conventional cleaning machines are generally of two types. The first type of cleaning machine utilizes sprayers for spraying solvents or other cleaning solutions against the parts or components being treated. High pressure sprayers are directed at various angles relative to the parts and the parts are either conveyed in a batch, such as in a basket, or continuously along a conveyor. In some spraying systems, it is necessary to use toxic solvents to effectively remove oils, tars and other debris from the parts being cleaned. However, in spray systems, it is difficult to adequately clean all portions of the parts, especially small bores or other openings or blind holes which are not easily accessed by directed sprays. One example of a parts cleaning machine utilizing an enclosed sprayer is disclosed in U.S. Pat. No. 4,170,240 to Gentry.

In other parts cleaning systems washing tanks are used into which parts are immersed in a batch process. In a typical immersion system, a tank of cleaning solution is provided into which the parts are introduced in open baskets. The baskets are lowered into the tanks wherein the parts retained in the baskets are subjected to an agitated liquid bath. In some instances, spray nozzles are utilized within the bath to obtain further cleansing of the parts by directed jets of liquid. Such immersion cleaning systems have utilized more conventional and less toxic washing detergents to effect cleaning of parts. Some examples of prior art immersion cleaning systems are disclosed in applicant's prior U.S. Pat. No. 4,651,762, and U.S. Pat. No. 3,910,297 to Pinkham.

As further disclosed in the U.S. Patent to Pinkham, in many industrial cleaning machines, it is necessary to provide separate tanks for retaining rinsing liquids and lubricants or rust inhibiting liquids which are applied to parts after they have been cleaned. In these instances, separate immersion tanks are provided into which trays or baskets of parts are subsequently immersed. Unfortunately, as the parts are sequentially moved from one immersion tank to another, cleaning, rinsing and other liquids become mixed. Thus, the rinsing or cleaning liquids contaminate the lubricating or rust inhibiting liquids, and the cleaning liquids contaminate the rinsing liquids.

Additional examples of related art are disclosed in U.S. Pat. Nos. 3,476,126 to Pinkham and 3,952,756 to Sheppard.

SUMMARY OF THE INVENTION

A compact batch cleaning system for industrial and mechanical parts which includes an immersion washing tank into which one or more open mesh baskets may be selectively lowered by a hoist assembly which is disposed within a housing above the wash tank. Before being immersed, lids are lowered into engagement with the parts in the baskets to prevent the parts from shifting during the cleaning process. The hoist assembly includes a basket support frame which is rotatable about a horizontal axis after the frame has been lowered into the wash tank. The liquid within the wash tank is agitated by a turbo charger and is continuously recycled and filtered to remove particulate matter. After being filtered, the liquid is directed back into the wash tank through a plurality of fluid jet nozzles mounted therein. The nozzles are directed to both recycle particulate matter being washed from the parts and to direct liquid against the parts which are rotated within the wash tank.

The system further includes a plurality of sprayers mounted within the housing above the wash tank. A number of the sprayers receive pressurized rinse liquid from a rinse tank mounted adjacent the wash tank while other nozzles are associated with a rust inhibit, or other chemical tank, and serve to discharge a spray of rust inhibitor or other chemical against parts which have been washed and rinsed.

A collection tray which is selectively positioned between the housing and the wash tank and which receives the rinse liquid and rust inhibitive liquid and conveys the liquids back to either the rinse tank or the chemical tank. A shiftable nozzle is associated with the collection tray and is movable to selectively direct the liquid being collected to either the rinse tank or the chemical tank.

In the preferred embodiment, a blow dryer is mounted within the housing and is activated after rust inhibitor has been sprayed on the parts being treated.

Sensors are provided within the system and monitor the level of wash and rinse liquid. Make up liquid is automatically supplied to the wash tank from the rinse tank and from a source of deionized water to the rinse tank. Further sensors are provided within the wash tank to monitor the detergent concentration. The sensors measure the electrical conductivity of the solution in the wash tank and when the level drops to a predetermined level, additional detergent is supplied so as to adequately retain the wash liquid in a properly concentrated condition. Sensors are also provided to monitor the conductivity in the rinse tank so that when too much detergent accumulates therein, the tank may be purged and fresh water added.

Each of the wash, rinse and rust inhibit tanks are provided with their own filtration circuits to maximize the recycling and reuse of the liquids contained therein.

It is the primary object of the present invention to provide a combination immersion and spray system for cleaning, rinsing, and otherwise chemically treating parts, machine elements and other materials utilized in maintenance and in industry to remove grease, grime, cuttings and other materials therefrom and which is designed to maximize liquid conservation, and minimize cross contamination of the washing liquid, rinsing liquid and rust inhibitor or other chemical treatment liquid utilized with the system.

It is yet another object of the present invention to provide a parts cleaning, rinsing and chemical treating system which provides maximum efficiency in removing grease, oil, tar, cuttings and other debris from machined parts and other elements by rotating such parts and elements in a wash tank in which the liquid is agitated by a turbo charger. Spray jets are also utilized in a recirculation and filtration system to ensure removal of particles and other debris from the wash tank and to further break up any accumulation of oils on the surface of the wash tank which might otherwise contaminate parts as they are being raised from the wash tank prior to rinsing.

It is also an object of the present invention to provide an industrial parts washing and cleaning machine which utilizes both an immersion washing tank and spray rinse and spray chemical treatment to provide a cleaning system which is more economical to operate than prior art batch immersion systems and is more compact.

It is another object of the present invention to provide a combination immersion and spray system for washing, rinsing, and chemically treating industrial parts wherein the system is compact and wherein liquids utilized in rinsing and chemically treating are collected by a selectively movable tray which is utilized to direct liquids to proper retention tanks.

Another object of the present invention is to monitor wash and rinse tank levels and concentrations to ensure efficient washing and cleaning.

A further object of the invention is to positively secure parts being cleaned using clamping lids which cooperate with the parts support baskets to prevent damage to parts being treated.

DESCRIPTION OF THE PREFERRED EMBODIMENT

Figure 1:
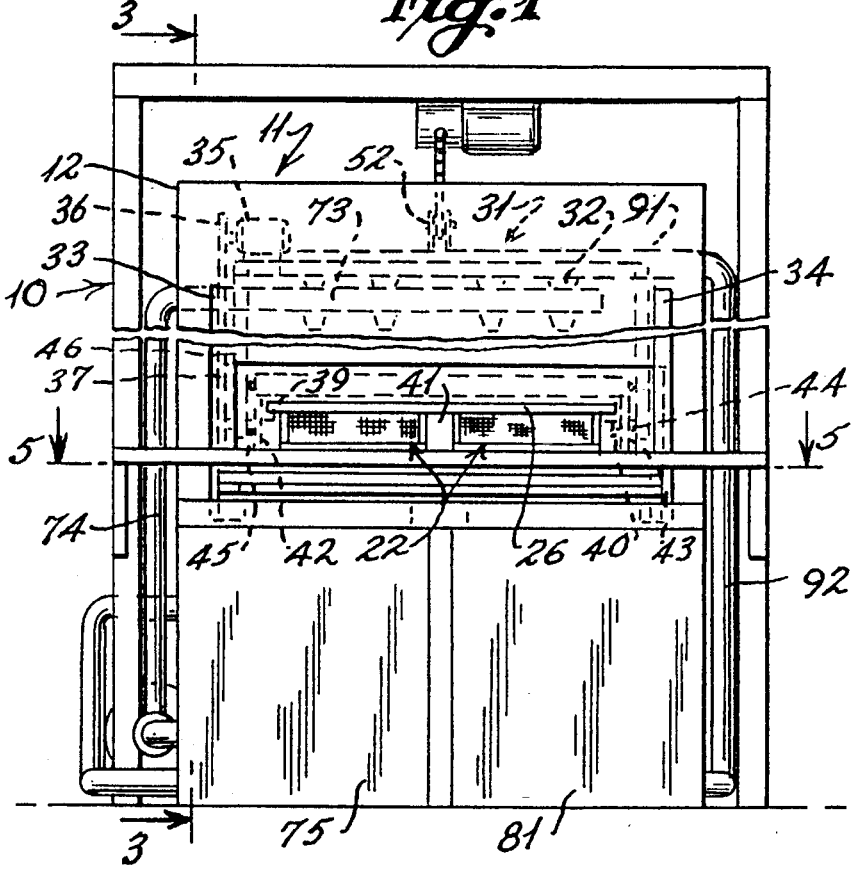
FIG. 1 is a front plan view of the parts cleaning system of the present invention with a door in the upper housing being open showing the parts retaining baskets received in a hoist and the basket support assembly.

With continued reference to the drawings, the parts cleaning system 10 of the present invention includes an upper housing 11 having sidewalls 12, front wall 13, rear wall 14 and upper wall 15. A hoist mechanism 16 is mounted to a frame component 17 extending from the upper wall and in alignment with an opening 18 in the upper wall of the housing. The hoist 16 may take various forms and in the drawings it is shown as being a rotating line hoist having a fixed line segment 19 and play out and rewind segment 20. The segment 20 is mounted about a rotating hub inside the hoist. As the hoist is activated the segment 20 is played out or played in relative to the reel as will be discussed in greater detail hereinafter. As opposed to a line hoist, pneumatic or hydraulic cylinders or mechanical jack screw arrangements may be utilized.

Parts to be treated are retained in open mesh baskets 22. The baskets are retained on a loading table 23 which extends outwardly from an opening 24 into the housing which opening is normally closed by a door 25. The baskets are open at the top and include a pair of outwardly extending side flanges 26 for purposes of retaining the baskets in a mounted relationship with respect to a basket support mechanism 30 provided within the housing 11.

The basket support mechanism includes a yoke assembly 31 having a crossbar 32 and a pair of spaced arms 33 and 34. An electric or hydraulic motor 35 is mounted on the crossbar 33 and includes a drive sprocket 36 which drives a continuous chain 37. The basket support mechanism further includes a basket support frame which has an upper vertically adjustable lid assembly 38 which is engageable with parts within the baskets 22 when the baskets are mounted within the frame. The lid assembly will be discussed in greater detail hereinafter. The frame further includes a pair of opposing channels 39 and 40 and an intermediate channel member 41 which support the flanges 26 of the baskets 22. As shown in FIG. 1, two baskets are mounted within the basket support frame. In some instances, the width of the baskets from front to rear may be varied and four baskets of a smaller width dimension may be positioned within the support frame.

Figure 3:
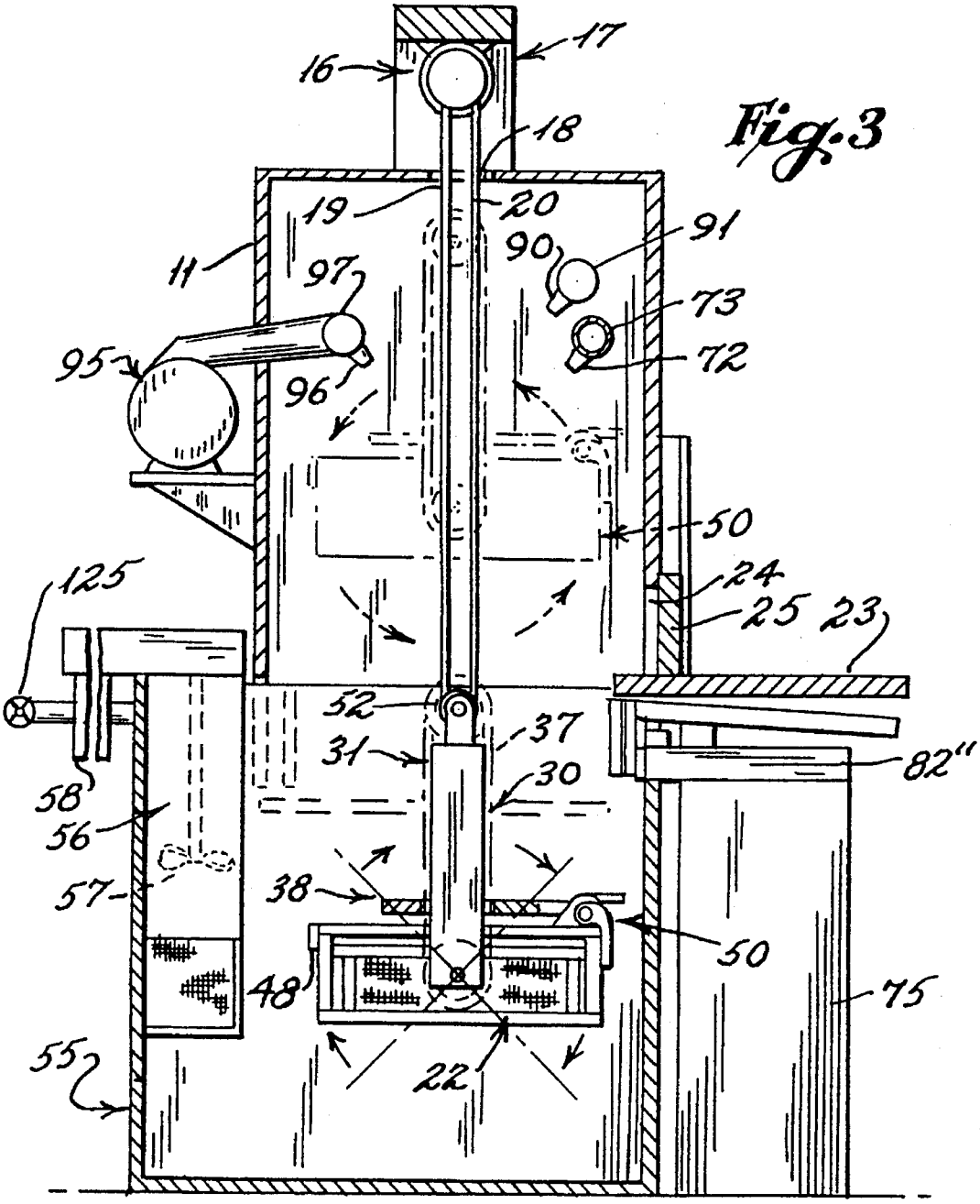
FIG. 3 is a cross sectional view of the parts cleaning system shown in FIG. 2 showing the basket support immersed in the wash tank in full line and showing the basket support raised for rinsing and chemical treatment in broken line.
Figure 7:
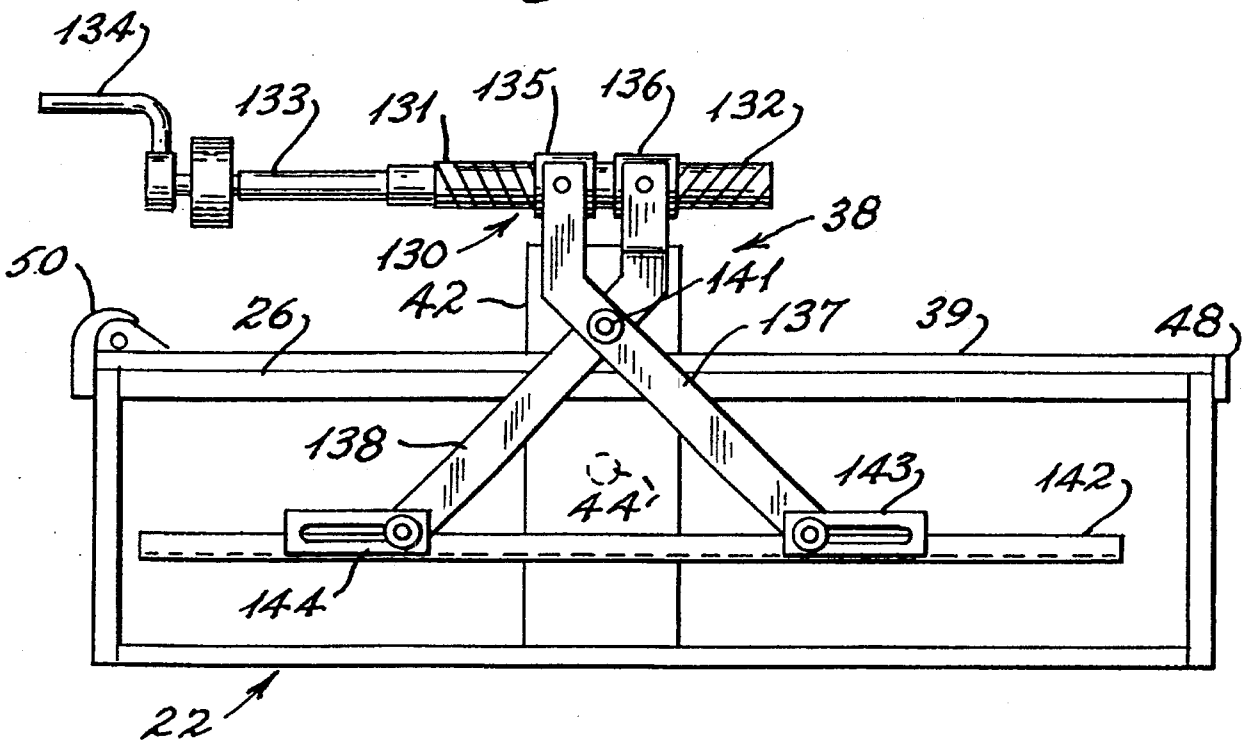
FIG. 7 is an enlarged cross-sectional view through a parts receiving basket and showing the adjustable lid assembly for retaining parts therein.

The support frame further includes a pair of spaced hanger elements 42 and 43 having stub shafts 44 and 45 extending therefrom. The stub shafts are fixed to the sidewalls 42 and 43. The stub shaft 45 has an outer end portion to which is mounted a driven sprocket 46 which is engageable with the chain 37 so that the sprocket is driven by the motor 35 to thereby rotate the stub shaft 43 which thereby rotates the basket support frame relative to the yoke assembly 31. The support frame further includes a pair of vertically extending channel members 48 which engage the sidewalls of the baskets when they are inserted within the channels 39, 40 and 41. To retain the baskets in position within the rotator frame, a latch assembly 50 is provided which is pivotable with respect to the front of the baskets after the baskets have been positioned within the support frame, as is shown in FIGS. 3 and 7.

To raise and lower the basket support mechanism, a pulley assembly 52 is mounted to the crossbar 32 of the yoke assembly 31. The hoist line segment 19 extends around the pulley and back to the hoist mechanism, as is shown in FIG. 3. Upon activation of the hoist mechanism, the line segment 20 will be played out thereby lowering the basket support mechanism, as is shown in FIG. 3.

As noted in FIG. 3, the bottom of the housing 11 is open to allow the basket support mechanism to be lowered into a wash tank 55 which is positioned immediately below the housing 11. The wash tank 55 is normally filled with a detergent solution which is agitated by turbo charger assembly 56. The turbo charger includes an impeller 57 driven by a motor 58 which circulates water through a discharge and back into the tank so as to maintain an agitated state within the tank at all times when parts are being washed. The agitation flushes the parts immersed within the wash tank and prevents the buildup of oils on the surface of the wash tank which would otherwise contaminate the parts being cleaned as the parts are raised from the wash tank following a wash cycle.

With respect to the agitation turbo charger, incorporated herein by reference is applicant's previous U.S. Pat. No. 4,651,762 issued Mar. 24, 1987 to a parts degreaser. This patent discloses a wash tank having a turbo charger associated therewith for agitating liquid within the tank. The reference also discloses skimmer elements for removing oil from calm surface areas created within the tank. The same type of structural elements may be utilized in combination with the wash tank 55 of the present invention.

Figure 6:
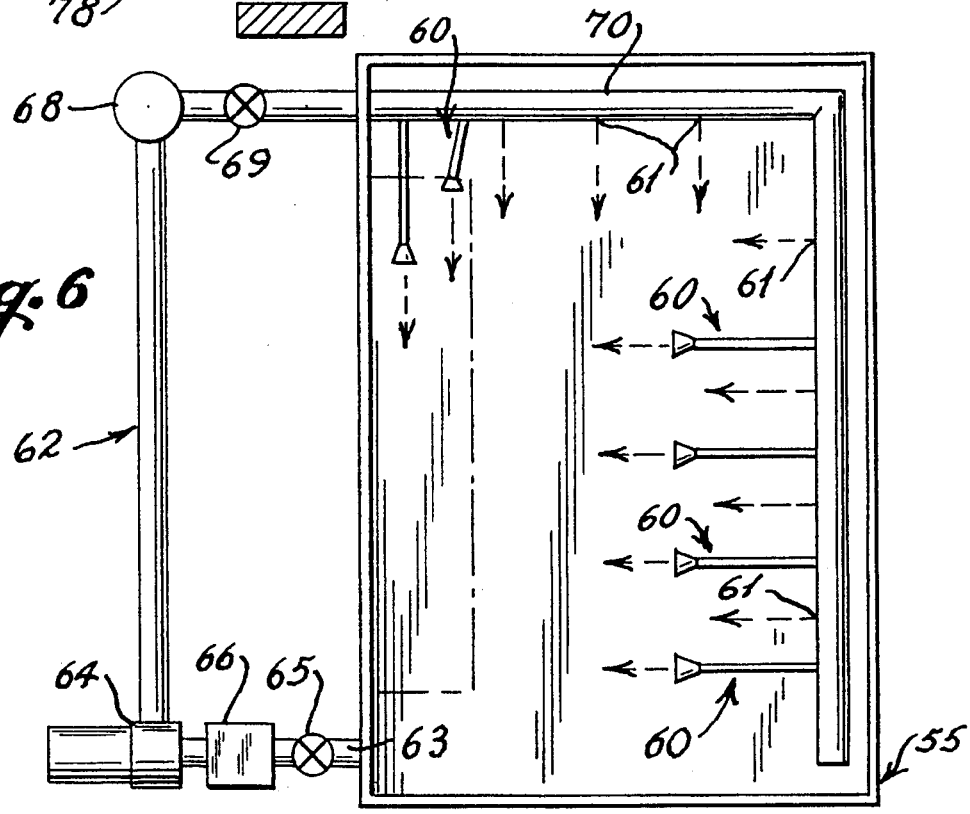
FIG. 6 is a top plan view of the jet spray and filter system associated with the system wash tank.

With particular reference to FIG. 6, the top plan view of the wash tank 55 is shown together with a liquid filtration circuit. As shown, a plurality of nozzles and jets 60 and 61 are positioned along the side walls of the tank and are oriented at various angles in order to direct liquid toward parts being rotated within the tank and to direct debris and particles being washed from the parts being cleaned toward the fluid filtration circuit 62. The fluid filtration circuit includes an outlet 63 which communicates with a pump 64 through a control valve 65 and a strainer trap 66. The strainer trap is designed to remove particles larger than approximately 420 microns from the recirculated cleaning liquid. The strainer includes a removable strainer cup which may be removed and cleaned as is necessary. During cleaning of the particle trap, the valve 65 is closed to prevent circulation of liquid through the circulation system 62. During the recycling and cleaning of the washing fluid, the pump directs the fluid from which larger particles have been removed to a secondary filter 68 which removes particles down to approximately 50 micron. When the filter 68 is to be cleaned, an outlet isolation valve 69 and the inlet isolation valve 65 are closed to prevent fluid flow through the recycling circuit. Once the recycled liquid has been filtered, it is introduced into headers 70 associated with the outlet nozzles and jets 60 and 61, respectively.

After the parts have been cleaned by being flushed in the wash tank 55, the hoist mechanism is operated to retract the line segment 20. This raises the basket support assembly 31 into the housing 11. The basket is raised generally centrally into the housing and the basket support frame is continuously rotated allowing any wash liquid to drip into the wash tank.

Figure 2:
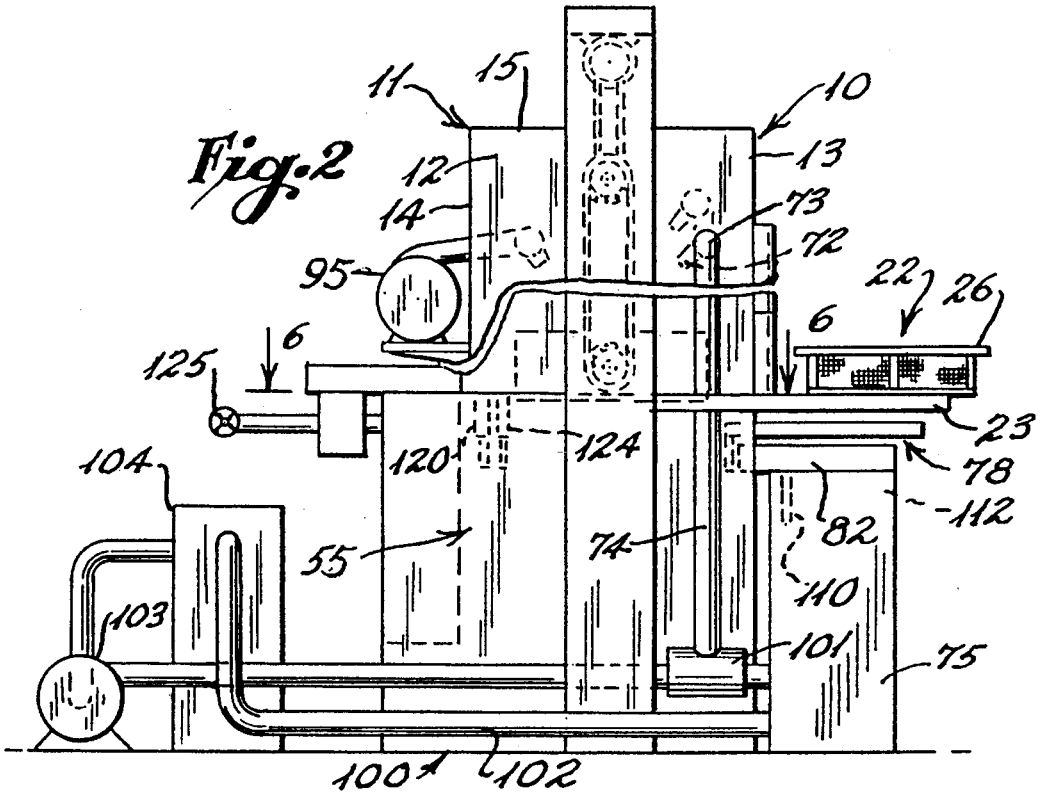
FIG. 2 is a side plan view of the system shown in FIG. 1.
Figure 4:
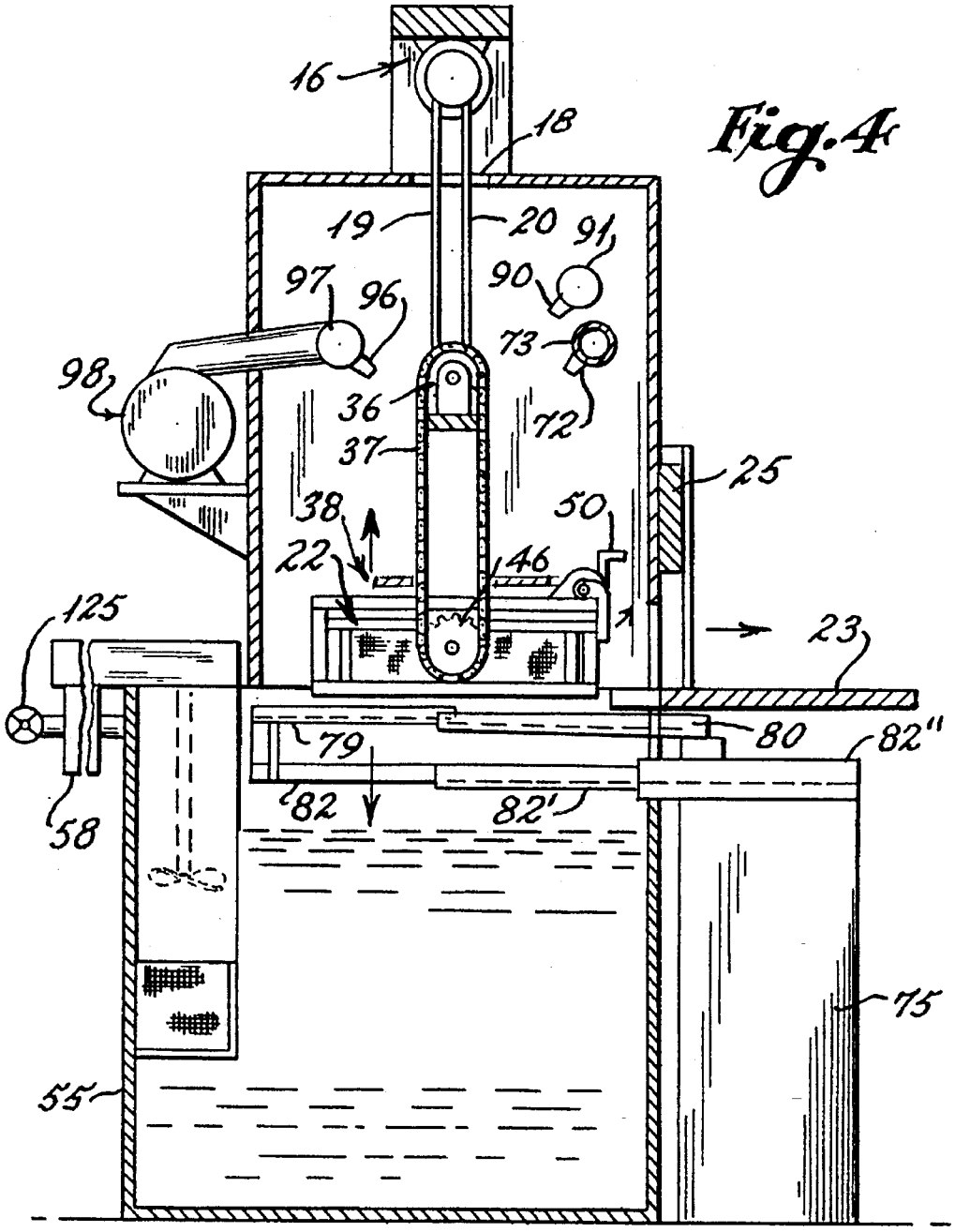
FIG. 4 is a cross sectional view of the parts cleaning system shown in FIG. 2.

The present invention includes a first plurality of rinse nozzles 72 which are mounted to a common header 73 which is connected by conduit 74 to a rinse tank 75 mounted forwardly of the housing 11. As the baskets are rotated, the parts are rinsed. The rinse spray will effectively contact every portion of the parts being treated. In order to collect the rinse water and to recycle the rinse water back to the rinse tank 75, a collector tray 78 is movably mounted intermediate the housing 11 and the wash tank 55. The collector tray 78 includes upper and lower sections 79 and 80 which are slidable with respect to one another so that as they are moved outwardly from between the housing and wash tank, as shown in FIG. 2, tray section 79 will overlay section 80 with both sections overlaying the rinse tank 75 and an adjacent chemical tank 81. The tray sections are supported by spaced telescoping rails 82 and 82' which extend from a frame 82" below the housing and above the wash tank 55. As shown in FIG. 4, when the basket is raised and the parts rotated and sprayed during a rinse cycle, the tray is positioned below the housing so as to receive the discharged rinse liquid.

Figure 5:
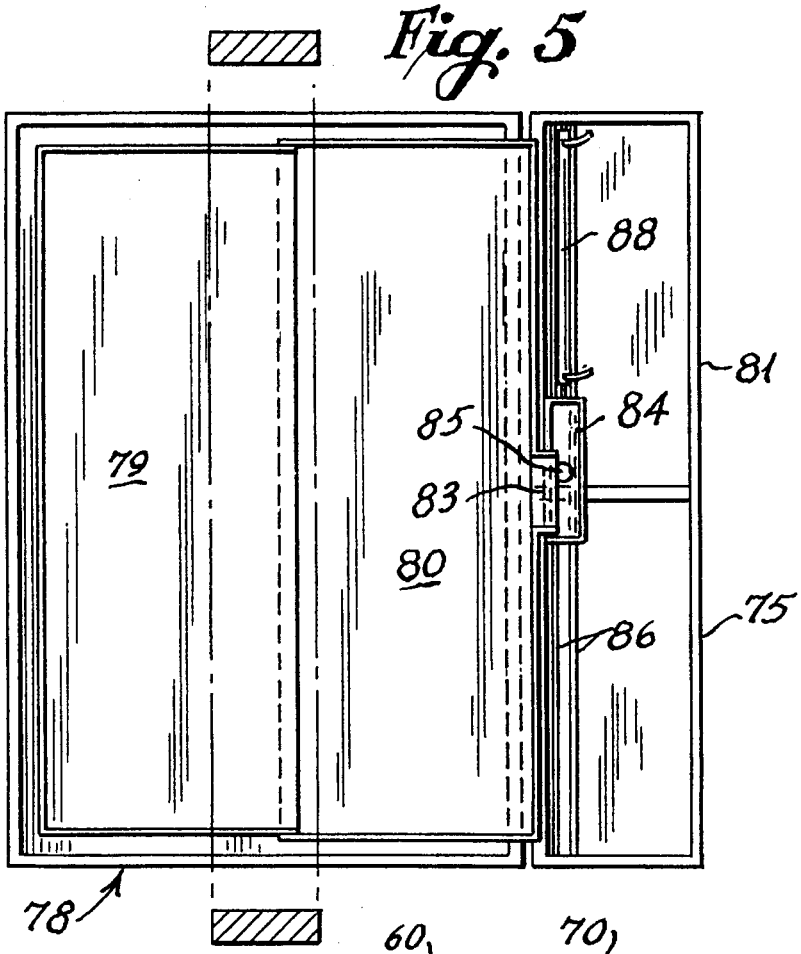
FIG. 5 is an enlarged top plan view of the tray and discharge nozzle assembly of the present invention.

With specific reference to FIG. 5, the tray sections are inclined slightly so that liquid being collected on the tray is channeled toward a centralized discharge spout 83. Mounted immediately beneath the spout 83 is a slide trough 84 having a discharge outlet 85. The trough 84 is slidably mounted on a pair of rails 86 which extend over the tanks 75 and 81. The trough is moved from side to side relative to the spout 83 by a piston member 88 so as to realign the discharge outlet 85 of the trough relative to the rinse tank 75 or the chemical treatment tank 81. During a rinse cycle, the trough outlet 85 is positioned above the rinse tank 75 so that all liquid being sprayed is recycled to the rinse tank.

Following rinsing, in many instances it is necessary to either apply a rust inhibitor or some other chemical agent, such as a light oil, to the parts being cleaned. In these instances, a second plurality of spray nozzles 90 are mounted to a common header 91 which communicates with a conduit system 92 extending from the chemical treatment tank 81. In the preferred embodiment, the chemical tank retains a rust inhibiting liquid which is sprayed through the nozzles 90 onto the parts in the rotating baskets. As with the rinse fluid, the collection tray 78 remains intermediate the housing 11 and the wash tank 55 as is shown in FIG. 4, thereby collecting the chemical rust inhibiting agent. During the application of the chemical agent, the collection trough 84 is moved so that the discharge outlet 85 is above the chemical tank 81 so that all chemical being collected by the tray will be deposited within the chemical tank.

After the chemical agent has been applied, the baskets are continuously rotated as they are dried by warm air which is supplied by a blower 95 having outlet nozzles 96 mounted within the housing and extending from a common header 97. Once the parts are dried, rotation of the baskets is terminated and the baskets are lowered into alignment with the opening into the housing, as is shown in FIG. 4.

With specific reference to FIG. 2, the rinse tank is provided with a filtration system 100 which includes a diverter valve 101 which, when in a first position, allows rinse water from the rinse tank 75 to be conveyed through a fluid conduit 102, filter 103 and pump 104 to the inlet conduit 74 communicating with the spray header 73 to which the nozzles 72 are attached to supply rinsing spray during the spray rinse cycle. The diverter valve is also operative to allow the liquid being passed through the rinse water filtration system to be reintroduced directly back into the rinse tank, when in a second position. The rinse liquid is preferably a deionized water. A sensor 110 is provided within the rinse tank 75 which measures the conductivity of the liquid. When the detergent content of the rinse liquid exceeds a predetermined lever, a solenoid valve automatically opens a deionized water supply line (not shown) to purge the tank until the conductivity of the fluid reaches a desirable level.

The level of water in the rinse tank is also monitored by a float switch or sensor 112. If the level drops a predetermined amount, the sensor will activate the supply solenoid valve to add deionized water to the tank.

Although not specifically shown, the chemical reservoir also includes a filtration system which would be substantially identical to that disclosed with respect to the rinse water filtration system. The system operates in the same manner and utilizes a diverter valve to either allow chemical agent to be conducted to the spray header 91 through the nozzles 90 to be sprayed onto the parts during a chemical treatment cycle or allows the chemical to be returned directly to the tank during a filtration cycle. Also, a sensor or float valve switch may be provided in the chemical tank which will activate an appropriate valve to permit additional chemical to be supplied to the tank if the level within the tank drops to a predetermined level.

The present invention further provides means for automatically conveying water from the rinse tank 75 to the wash tank 55 in the event that additional water is needed because of a low liquid level within the wash tank. A sensor 120 is provided in the wash tank and activates a pump 121 to introduce water through lines 122 from the rinse tank 75 in the event the level within the tank reaches a predetermined level. In a like manner, another sensor 124 is provided within the wash tank 55 for monitoring the electrical conductivity of the cleaning solution. When the electrical conductivity indicates that insufficient detergent remains in solution, the sensor activates a supply valve 125 which allows additional detergent to be supplied from a source (not shown) into the wash tank.

Figure 8:
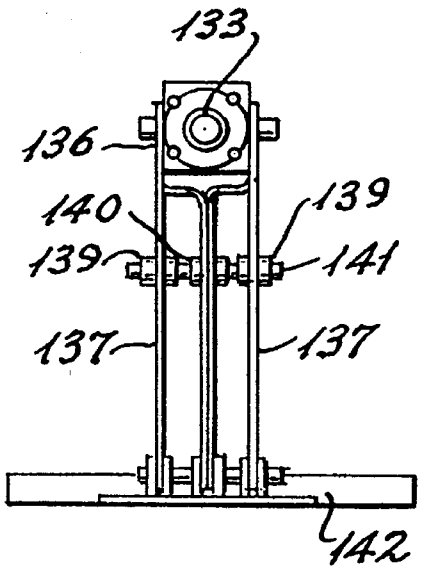
FIG. 8 is an end view of the lid assembly of FIG. 7.

As previously discussed, the parts are securely retained within the baskets 22 during washing, rinsing and chemical treatment by a selectively operable lid assembly 38. With particular reference to FIGS. 7 and 8, the assembly includes a scissor jack 130 having a pair of aligned oppositely threaded shaft sections 131 and 132 which are mounted to a shaft 133. A crank handle 134 is mounted to the shaft 133 and is maneuverable to rotate the shaft sections 131 and 132. A pair of follower nuts 135 and 136 are mounted in threaded engagement with the shaft sections 131 and 132 so that as the crank is rotated, the followers will travel in opposite directions. A pair of spaced depending scissor arms 137 are mounted to opposite sides of the follower 135 and a single depending scissor arm 138 is mounted to follower 136. The scissor arms are pivotably connected by bearings 139 and 140 about a rod 141 which is mounted at its ends to the hanger elements 42 and 43. A lid 142 of a size to be lowered into the open top of a mesh basket 22 is connected to the scissor arms 137 and 138. The lid includes a pair of brackets 143 adjacent one end thereof and a single bracket 144 aligned intermediate brackets 143 adjacent the other end thereof. Each bracket has a slot therein in which follower bearings 145 and 146 are retained. As the crank handle 134 is rotated, the follower nuts 135 and 136 will cause the scissor arms 137 and 138 to pivot about rod 141. In FIG. 7, if the crank handle is rotated to raise the lid 142, the lower ends of the scissor arms which support the follower bearings 145 and 146 will shift within the slots until the lid is raised from the basket 22. The lid assemblies are provided so that intimate contact is assured between the lid 142 and parts (not shown) within the baskets before the baskets are rotated during the wash-rinse-treatment-drying-cycle. In the embodiment shown, a separate lid assembly is provided for each basket.

In the use of the parts cleaning system of the present invention, parts are loaded into two or more open mesh open top baskets which are generally of the size of approximately 12"×18"×6" or 12"×9"×6". Baskets filled or partially filled with parts to be cleaned are introduced through the opening 24 into the housing when the door 25 to the housing is open. The trays are slid into the opposing and intermediate channel members 39, 40 and 41 of the support frame 40. Thereafter, the latch mechanism 50 is activated to close against the front end of the trays or baskets, as is shown in FIG. 3, to thereby retain the baskets in mounted relationship with respect to the basket support assembly. The crank of the jack mechanisms are thereafter rotated to lower the lids into the open baskets until the parts therein are engaged. The lids will prevent the parts from shifting during cleaning, rinsing, chemical treatment and drying. Thereafter, the hoist mechanism is operated to lower the basket support mechanism and the baskets into the wash tank 55. The wash liquid in the tank is agitated by the turbo charger 56 and the parts are flushed by the cleaning solution. The parts are further cleaned by the force generated by the jets and nozzles 60 and 61. During the wash cycle, the baskets are continuously rotated by the activation of the motor 35. Upon completion of the wash cycle, the hoist mechanism is again activated to raise the basket support mechanism so that the baskets are positioned within the housing 11, as is shown in dotted line in FIG. 3. Thereafter, and with the baskets being continuously rotated, the parts are rinsed by conveying rinsing liquid from the rinse tank 75 to the header 73 and through the spray nozzles 72. During this procedure, the collection tray is positioned intermediate the housing and the wash tank, as shown in FIG. 4, and the spray passing through the parts is collected and returned to the rinse tank.

Following the rinse cycle, a chemical agent is applied to the parts. The chemical agent may be a rust inhibitor, oil or some other fluid. In the preferred embodiment, the rust inhibiting agent is supplied from the tank 85 through the header 91 and nozzles 90 and directed to the parts being supported within the rotating baskets. The chemical is thereafter channeled by the collection tray back to the chemical tank 81.

Following chemical treatment, the air blower 95 is activated and air is discharged to dry the parts. The rotation of the baskets is subsequently terminated, the lids raised and the latch mechanism released. The baskets are then removed from the housing to the support table 23.

I claim:

1. A method of cleaning industrial parts, comprising the steps of:

a) placing the parts in an open mesh basket having an open top;

b) placing the basket on a vertically adjustable hoist disposed within a housing;

c) lowering the basket through an opening in a wash tank containing an agitated wash solution;

d) rotating the basket within the wash solution;

e) raising the basket from the wash solution through said opening to within the housing above said wash tank;

f) rotating the raised basket while spraying the parts with a rinse liquid supplied from a rinse liquid source;

g) simultaneously with the step of spraying sliding a liquid collection means into a horizontal position below the raised basket intermediate said housing and said wash tank to cover said wash tank and to collect the sprayed rinse liquid and discharge the collected sprayed rinse liquid into the rinse liquid source, said liquid collection means being displaced from the opening of said wash tank and horizontally spaced relative to the basket during the steps of lowering and raising the basket; and h) removing the basket from the hoist.

2. The method of claim 1 further comprising the step of clamping the parts within the basket prior to lowering the basket into the washing solution.

3. The method of claim 2 further comprising the step of directing a spray toward the basket as it is being rotated within the wash solution.

4. The method of claim 3 further comprising the steps of spraying the parts with a rust inhibitive chemical supplied from a chemical source after rinsing while the basket is being rotated and collecting the sprayed chemical in said liquid collection means and returning the sprayed chemical to the chemical source.

5. The method of claim 4 further comprising the step of drying the parts after being sprayed with the chemical.

6. The method of claim 1 further comprising the step of drying the parts after rinsing.

7. A method of cleaning parts, comprising the steps of:

a) placing the parts in an open mesh basket;

b) securing the basket on a vertically movable hoist disposed within a substantially closed, stationary housing;

c) lowering the basket through an opening in a wash tank containing an agitated wash solution, said wash tank being disposed below the housing;

d) rotating the basket within the wash solution;

e) raising the basket from the wash solution through said opening to within said housing above said wash tank;

f) spraying the parts with a rinse liquid from a first sprayer mounted within said housing while rotating the raised basket, the first sprayer being supplied from a rinse liquid source;

g) simultaneously with the step of spraying horizontally sliding a tray below the raised basket intermediate said housing and said wash tank to cover said wash tank and to collect the sprayed rinse liquid and discharge the collected sprayed rinse liquid into the rinse liquid source, said tray being displaced from the opening of said wash tank and maintained horizontally positioned relative to the basket during the steps of lowering and raising the basket; and h) removing the basket from the hoist.

8. The method of claim 7, further comprising the step of spraying the parts after rinsing with a rust inhibitive chemical from a second sprayer mounted within the housing while the basket is being rotated, the second sprayer being supplied from a chemical source.

9. The method of claim 8, further comprising the step of collecting the sprayed rust inhibitive chemical in the tray and discharging the collected rust inhibitive chemical into the chemical source.

10. The method of claim 9, further comprising the step of drying the parts after being sprayed with the rust inhibitive chemical.

11. The method of claim 7, further comprising the step of fixing the parts within the basket prior to being lowered into the washing solution.

12. The method of claim 7, further comprising the step of directing a spray toward the basket as it is being rotated within the wash solution.

13. The method of claim 7, further comprising the step of drying the parts after rinsing.

14. A method of cleaning parts, comprising the steps of:

a) placing the parts in an open mesh basket;

b) placing the basket on a vertically adjustable hoist disposed within a stationary housing;

c) lowering the basket through an opening in a wash tank containing an agitated wash solution, said wash tank being disposed below the housing;

d) rotating the basket within the wash solution;

e) raising the basket from the wash solution to within said housing;

f) spraying the parts with a rinse liquid supplied from a rinse liquid source while rotating the raised basket;

g) sliding an adjustable tray under the raised basket to cover said wash tank and collect the sprayed rinse liquid and discharging the collected rinse liquid into the rinse liquid source;

h) spraying the parts with a rust inhibitive chemical supplied from a chemical source while rotating the raised basket;

i) collecting the sprayed rust inhibitive chemical in the tray and discharging the collected rust inhibitive chemical into the chemical source;

j) removing the basket from the hoist; and k) sliding said adjustable tray to a displaced position from the opening of said wash tank and maintaining said adjustable tray horizontally positioned relative to the basket during the steps of lowering and raising.

15. The method of claim 14, further comprising the step of fixing the parts within the basket prior to being lowered into the washing solution.

16. The method of claim 14, further comprising the step of directing a spray toward the basket as it is being rotated within the wash solution.

* * * * *